US007954743B2

(12) United States Patent
Guerrero Palma

(10) Patent No.: US 7,954,743 B2
(45) Date of Patent: Jun. 7, 2011

(54) ROLLER MILL

(75) Inventor: Pedro Guerrero Palma, Lippetal (DE)

(73) Assignee: Polysius AG, Beckum (DE)

( * ) Notice: Subject to any disclaimer, the term of this patent is extended or adjusted under 35 U.S.C. 154(b) by 212 days.

(21) Appl. No.: 12/514,519

(22) PCT Filed: Nov. 8, 2007

(86) PCT No.: PCT/EP2007/062078

§ 371 (c)(1),
(2), (4) Date: May 12, 2009

(87) PCT Pub. No.: WO2008/068125

PCT Pub. Date: Jun. 12, 2008

(65) Prior Publication Data

US 2010/0012760 A1 Jan. 21, 2010

(30) Foreign Application Priority Data

Dec. 8, 2006 (DE) ..... 10 2006 058 012

(51) Int. Cl.
*B02C 15/00* (2006.01)
*B02C 9/04* (2006.01)
*B02C 19/00* (2006.01)

(52) U.S. Cl. ..... 241/117; 241/221

(58) Field of Classification Search ..... 241/117, 241/118, 120, 221

See application file for complete search history.

(56) References Cited

U.S. PATENT DOCUMENTS

| | | | | |
|---|---|---|---|---|
| 2,342,255 | A | 2/1944 | Doyle | |
| 4,610,401 | A | 9/1986 | Maliszewski | |
| 4,896,837 | A | 1/1990 | Heinemann et al. | |
| 5,529,253 | A * | 6/1996 | Maillet et al. | 241/121 |
| 7,028,934 | B2 * | 4/2006 | Burynski et al. | 241/121 |
| 7,226,010 | B2 * | 6/2007 | Zhang et al. | 241/121 |
| 7,341,212 | B2 * | 3/2008 | Viljoen et al. | 241/117 |

FOREIGN PATENT DOCUMENTS

| | | |
|---|---|---|
| DE | 742 912 | 12/1943 |
| DE | 126241 A1 | 7/1977 |
| JP | 6-154633 | 6/1994 |
| JP | 2000 312 832 | 11/2000 |
| JP | 2002 159 874 | 6/2002 |

* cited by examiner

*Primary Examiner* — Bena Miller
(74) *Attorney, Agent, or Firm* — Gifford, Krass, Sprinkle, Anderson & Citkowski, P.C.

(57) ABSTRACT

The invention relates to a roller mill having at least one mill roller and a rotatable mill platen, which are arranged in a mill inner space, and a moment arm which is retained so as to be pivotably movable and rotationally secure in a bearing, with the mill roller being supported in a rotatable manner at one end of the moment arm and there further being provided means for applying a force to the moment arm comprising a pressure cylinder which is in operative contact with the moment arm in order to adjust the mill pressure which is applied by the mill roller. The contact location, at which the force of the pressure cylinder is transmitted to the moment arm, is located outside the mill inner space.

10 Claims, 3 Drawing Sheets

ROLLER MILL

The invention relates to a roller mill having at least one mill roller and a rotatable mill platen.

In practice, extremely different configurations of roller mills are known. In one configuration, the mill roller is secured to one end of a rotatable shaft which is retained outside the mill in a spherical roller bearing. In another configuration, a moment arm is provided and is retained so as to be pivotably movable and rotationally secure in a bearing, the mill roller being supported rotatably at one end of the moment arm. There are further provided means for applying a force to the moment arm in order to adjust the pressure which is applied by the mill roller. The means for applying a force to the moment arm are formed by resilient elements in many applications. In order better to be able to vary the mill pressure and also to be able to adjust relatively large mill pressures, however, hydraulic cylinders are used in many cases.

In JP-A-2002 159 874, that hydraulic cylinder is formed by a tension cylinder which is supported in an articulated manner and which is connected to the moment arm in an articulated manner.

JP-A-2000 312 832 further discloses a coal mill, wherein the moment arm is operatively connected to a pressure cylinder in order to adjust the pressure which is applied by the mill roller. The cylinder is mounted on the housing wall so as to be fixed in position so that the cylinder piston protrudes into the mill inner space and, at that location, transmits the force to the moment arm via a pad which is guided in a sleeve. Since the moment arm is supported in a pivotably movable manner, powerful transverse forces which have to be taken up by the sleeve occur in the region of the contact location.

The problem addressed by the invention is to find a new construction for introducing a force into the moment arm.

This problem is solved according to the invention by the features of claim 1.

The roller mill according to the invention substantially comprises at least one mill roller and a rotatable mill platen, which are arranged in a mill inner space, and a moment arm which is retained so as to be pivotably movable and rotationally secure in a bearing, with the mill roller being supported in a rotatable manner at one end of the moment arm and there further being provided means for applying a force to the moment arm comprising a pressure cylinder which is in operative contact with the moment arm in order to adjust the mill pressure which is applied by the mill roller. The contact location, at which the force of the pressure cylinder is transmitted to the moment arm, is located outside the mill inner space.

A pressure cylinder can be constructed so as to be smaller and more compact in comparison with a tension cylinder, whereby installation space is reduced. A contact location which is arranged outside the mill inner space further has the advantage that it is subject to less wear because no dust and no high temperatures are present at that location. The dependent claims relate to other constructions of the invention.

According to a preferred configuration, the pressure cylinder is arranged so as to be fixed in position. A fixed cylinder is firstly more compact, and reduces the movable masses of a roller unit which has a favourable effect with regard to vibrations.

The pressure cylinder is further advantageously orientated perpendicularly relative to the connection between the bearing and the mill roller, whereby it is possible to have optimum force transmission. The pressure cylinder is further preferably arranged in a central region between the mill roller and the bearing.

According to a preferred construction of the invention, there is provided between the pressure cylinder and the moment arm at least one pressure bearing which allows relative movement between the pressure cylinder and the moment arm. That pressure bearing can particularly have a first pressure face and a second pressure face in order to apply a sliding movement, with the friction coefficient preferably being less than 0.2. The relative movement between the fixed pressure cylinder and the pivotably movable moment arm can be compensated for by the pressure bearing to such an extent that the transverse forces which act on the pressure cylinder are minimised. In another construction of the invention, a third pressure face and a fourth pressure face are further provided in order to apply a pivoting movement in order to further minimise the transverse forces in that manner. By the pressure bearing being arranged outside the mill inner space, complex sealing of the bearing is unnecessary.

Further advantages and constructions of the invention will be explained in greater detail below with reference to the description and the drawings, in which.

Figure 1:
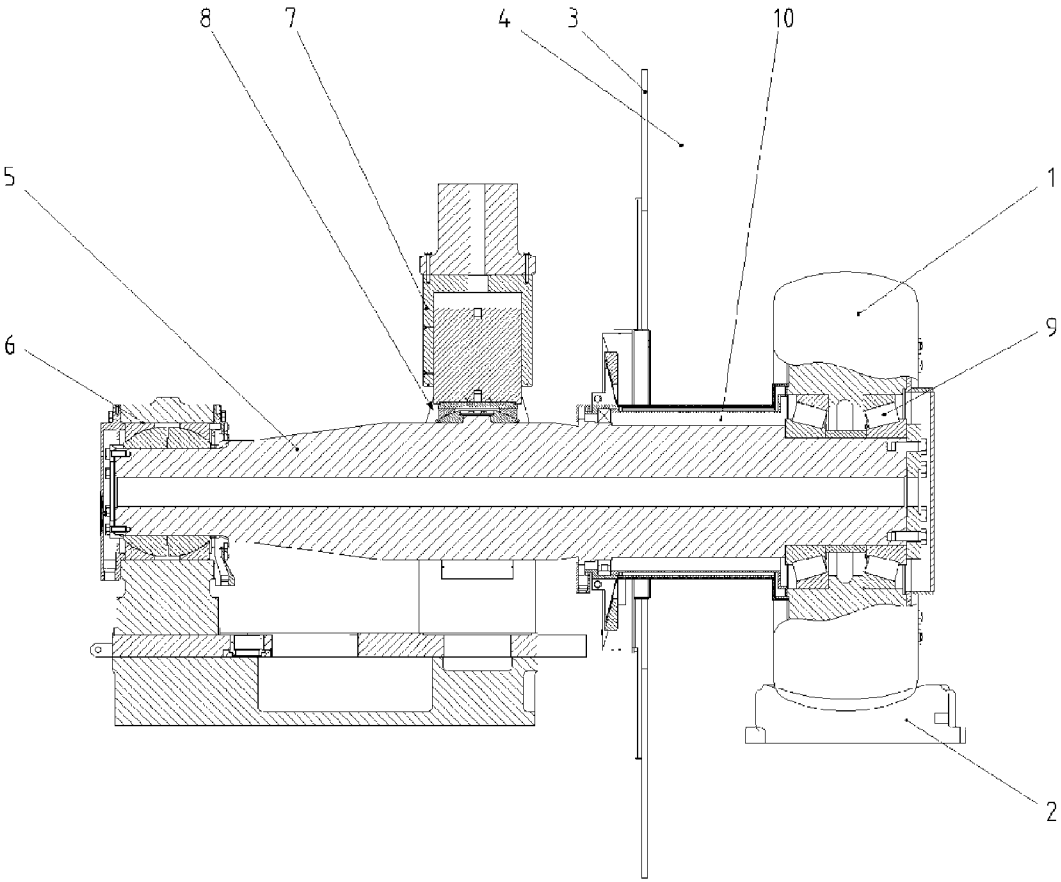
FIG. 1 is a partial sectioned view of the roller mill.

The roller mill illustrated in FIG. 1 substantially comprises a mill roller 1 and a rotatable mill platen 2 which are arranged in a mill inner space 4 which is delimited by a housing 3. A moment arm 5 is further provided and is retained so as to be pivotably movable and rotationally secure in a bearing 6 which is constructed as a fixed bearing, with the mill roller 1 being supported rotatably at the opposite end of the moment arm.

Means for applying a force to the moment arm 5 are further provided in order to adjust the pressure which is applied by the mill roller. Those means comprise a pressure cylinder 7 which is arranged so as to be fixed in position and which acts on the moment arm 5 substantially perpendicularly relative to the connection line between the bearing 6 and the mill roller 1. The pressure cylinder 7 is preferably formed by a plunger cylinder. A contact location 8, at which the force of the pressure cylinder 7 is transmitted to the moment arm 5, is located outside the mill inner space 4.

In the embodiment illustrated, the pressure cylinder 7 acts in a central region between the mill roller 1 and the bearing 6 on the moment arm 5. In the context of the invention, however, it would also be conceivable for the positions of the bearing and pressure cylinder to be transposed.

The moment arm 5 in the embodiment illustrated is further constructed so as to be rectilinear, but non-linear moment arms are also conceivable in principle.

The bearing 6 is preferably formed by an axial spherical plain bearing, there being used in particular two axial spherical plain bearings which are arranged opposite each other and which can be tensioned relative to each other, whereby the bearing play can be minimised. The mill roller 1 at the other end of the moment arm 5 is supported by means of two tapered roller bearings 9 which are mounted in an O-like arrangement, a lubricant space 10 of the tapered roller bearings 9 extending as far as a region outside the mill inner space 4 and being sealed at that location.

Figure 2:
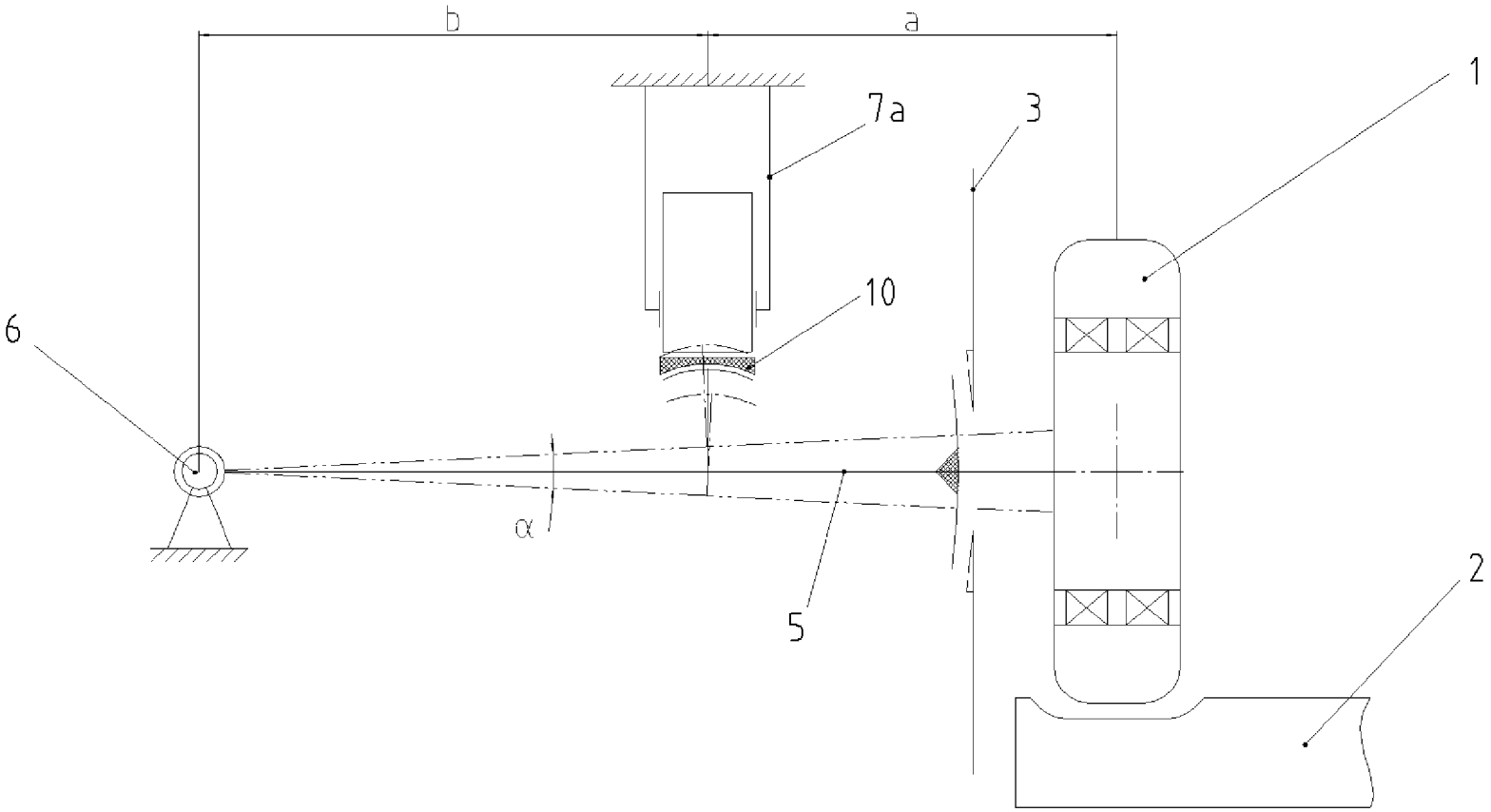
FIG. 2 is a schematic illustration of the roller mill.

As is visible in the schematic illustration of FIG. 2, the bearing 6 allows a pivoting movement of the moment arm 5 through an angle $\alpha$. Consequently, there is produced a relative movement between the fixed pressure cylinder 7 and the moment arm 5.

Figure 3:
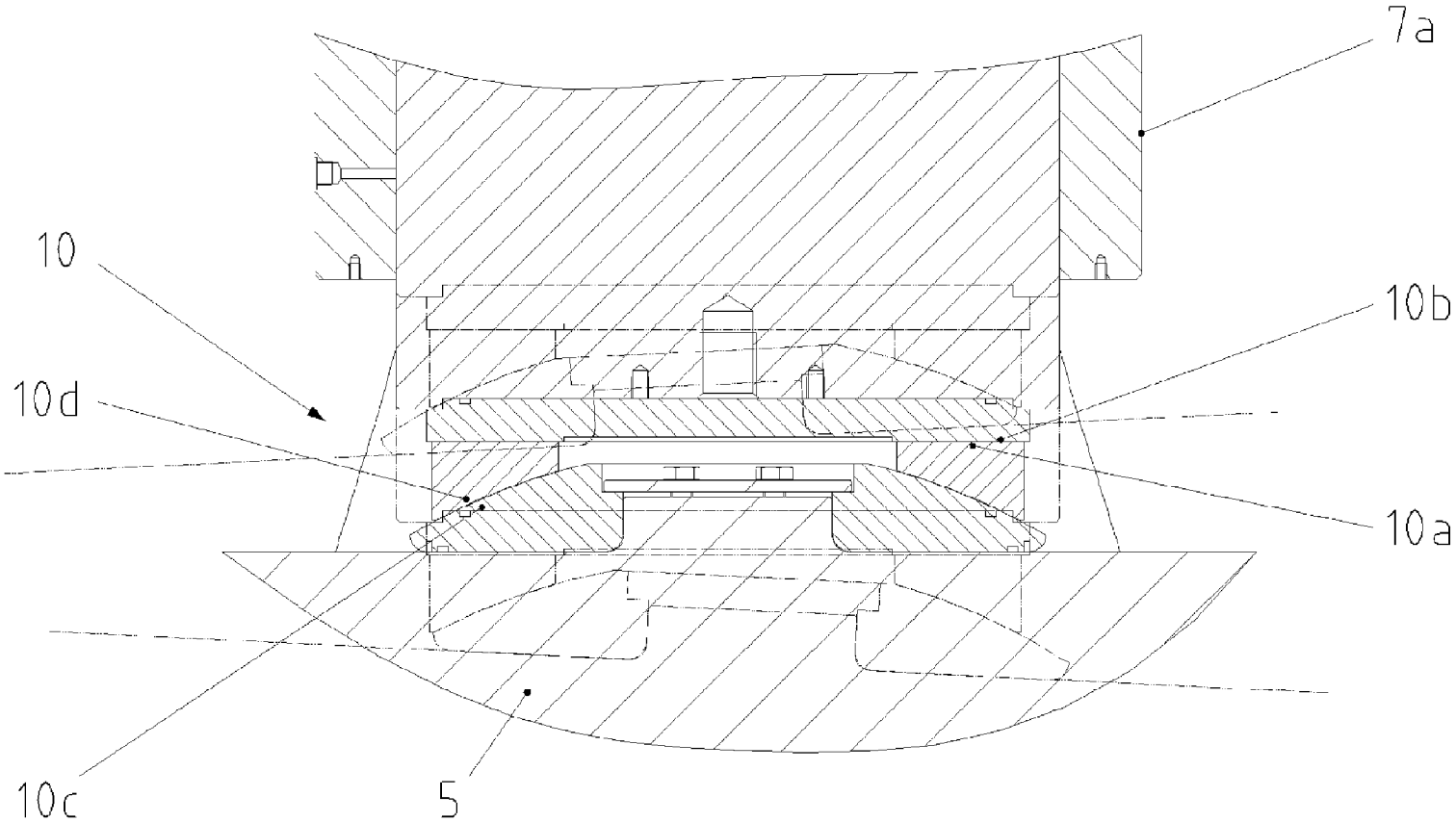
FIG. 3 is a partial sectioned view in the region of the contact location at which the force of the pressure cylinder is transmitted to the moment arm.

Since the pressure cylinder 7 is in constant operative contact with the moment arm 5, therefore, transverse forces are produced in the region of the contact location owing to the relative movement. In order to compensate for the relative movement between the pressure cylinder 7 and the moment arm 5, there is provided a pressure bearing 10 which allows relative movement between the pressure cylinder and the moment arm. The pressure bearing is illustrated in greater detail in FIG. 3 and has a first pressure face 10*a* and a second pressure face 10*b* in order to apply a sliding movement, a friction coefficient which is less than 0.2 being provided by the sliding pair being selected in a suitable manner. In order to further reduce the transmission of the transverse forces to the cylinder 7, there is further provided a third and a fourth sliding face for applying a pivoting movement. The friction coefficient can also be minimised in this instance by means of suitable sliding pairs. In FIG. 3, the central position of the moment arm is illustrated with solid lines and the two extreme positions of the moment arm in connection with the pressure bearing are illustrated with broken lines.

With this construction of the pressure bearing, the force transmission from the pressure cylinder to the moment arm can be carried out in a very compact manner.

It has further been found during attempts forming the basis of the invention that the relationship of the distance a between the pressure cylinder 7 and the mill roller 1 to the distance b between the pressure cylinder 7 and the bearing 6 should be in the order of 1:0.9 and 1:1.2, preferably in the order of 1:1.0 and 1:1.1, in order to minimise to the greatest possible extent the forces which act in the bearing 6, the pressure cylinder 7 and the corresponding counter-bearings. Corresponding reductions in weight are thereby possible in the elements involved.

The invention claimed is:

1. Roller mill having at least one mill roller (1) and a rotatable mill platen (2), which are arranged in a mill inner space (4), and a moment arm (5) which is retained so as to be pivotably movable and rotationally secure in a bearing (6), with the mill roller (1) being supported in a rotatable manner at one end of the moment arm and there further being provided means for applying a force to the moment arm which are in operative contact with the moment arm in order to adjust the pressure which is applied by the mill roller, the contact location (8), at which the force is transmitted to the moment arm (5) being located outside the mill inner space (4), wherein the means for applying the force to the moment arm comprise a pressure cylinder (7) which is in operative contact with the moment arm in order to adjust the pressure applied by the mill roller, and in that there is provided between the pressure cylinder and the moment arm (5) at least one pressure bearing (10) which allows relative movement between the pressure cylinder (7) and the moment arm (5).

2. Roller mill according to claim 1, characterised in that the pressure cylinder (7) acts on the moment arm (5) in a central region between the mill roller (1) and the bearing (6).

3. Roller mill according to claim 1, characterised in that the pressure bearing (10) has a first and a second pressure face (10*a*, 10*b*) in order to apply a sliding movement and a third and a fourth pressure face (10*c*, 10*d*) in order to apply a pivoting movement.

4. Roller mill according to claim 1, characterised in that the pressure bearing (10) has a first and a second pressure face (10*a*, 10*b*) in order to which allows a sliding movement with a friction coefficient which is less than 0.2.

5. Roller mill according to claim 1, characterised in that the pressure cylinder (7) is arranged so as to be fixed in position.

6. Roller mill according to claim 1, characterised in that the pressure cylinder (7) is orientated perpendicularly relative to the connection between the bearing (6) and the mill roller (1).

7. Roller mill according to claim 1, characterised in that the bearing (6) of the moment arm (5) is formed by an axial spherical plain bearing.

8. Roller mill according to claim 1, characterised in that the moment arm (5) is constructed so as to be rectilinear.

9. Roller mill according to claim 1, characterised in that the pressure cylinder (7) is formed by a plunger cylinder.

10. Roller mill according to claim 1, characterised in that the relationship of the distance (a) between the pressure cylinder (7) and the milling roller (1) to the distance (b) between the pressure cylinder (7) and the bearing (6) of the moment arm (5) is in the order of 1:0.9 and 1:1.2, preferably in the order of 1:1.0 and 1:1.1.

* * * * *